US006770043B1

(12) United States Patent
Kahn

(10) Patent No.: US 6,770,043 B1
(45) Date of Patent: Aug. 3, 2004

(54) HYDROTHERAPY SYSTEM WITH TRANSLATING JETS

(76) Inventor: Rocky Kahn, 808 Jessie St., Austin, TX (US) 78704

( * ) Notice: Subject to any disclaimer, the term of this patent is extended or adjusted under 35 U.S.C. 154(b) by 0 days.

(21) Appl. No.: 09/561,109

(22) Filed: Apr. 28, 2000

(51) Int. Cl.[7] ..... A61H 9/00

(52) U.S. Cl. ..... 601/160; 601/148; 601/158; 601/169

(58) Field of Search ..... 601/154–159, 601/160, 169, 168, 148, 55, 97–98, 100–103; 239/251, 258, 261, 264, 265, 226, 246; 4/541.6, 546, 547

(56) References Cited

U.S. PATENT DOCUMENTS 1,115,981 A * 11/1914 Specht ..... 601/136
3,868,949 A * 3/1975 Arneson ..... 4/541.6
3,880,154 A * 4/1975 Gabmeier ..... 601/157
4,099,522 A * 7/1978 Alenares ..... 601/156
4,339,833 A * 7/1982 Mandell ..... 4/541.6
4,404,697 A 9/1983 Hatcher
4,458,676 A * 7/1984 Pileggi ..... 601/105
4,704,071 A * 11/1987 McCullough ..... 417/85
4,716,604 A 1/1988 Watkins
4,724,553 A 2/1988 Bianchi
4,742,456 A 5/1988 Kamena
4,757,808 A * 7/1988 Effler, Jr. ..... 4/492
4,764,999 A 8/1988 Rushing
4,825,854 A 5/1989 Henkin et al.
4,839,930 A 6/1989 Watkins
4,853,987 A 8/1989 Jaworski
4,876,753 A 10/1989 Bucher
4,976,256 A * 12/1990 Marlin et al. ..... 5/670
5,014,372 A 5/1991 Thrasher et al.
5,117,233 A 5/1992 Hamos et al.
5,137,424 A * 8/1992 Daniel ..... 415/206
5,158,076 A 10/1992 Thomsen
5,173,973 A 12/1992 Mersmann
5,233,973 A * 8/1993 Gill et al. ..... 601/103
5,245,714 A * 9/1993 Haraga et al. ..... 4/541.2
5,418,985 A 5/1995 Antoine
5,704,079 A * 1/1998 Desnoyers ..... 4/541.6
5,704,549 A * 1/1998 Kephart et al. ..... 239/236
5,738,638 A 4/1998 Henkin et al.
5,746,374 A * 5/1998 Simonetti et al. ..... 239/240
5,803,365 A * 9/1998 Ruttenberg ..... 239/204
5,862,543 A 1/1999 Reynoso et al.
5,881,403 A 3/1999 Moreland
5,938,123 A * 8/1999 Heitzman ..... 239/380
5,983,416 A 11/1999 Idland
6,178,570 B1 * 1/2001 Denst et al. ..... 239/420
6,210,351 B1 * 4/2001 Korenaga ..... 5/670

* cited by examiner

*Primary Examiner*—Nicholas D. Lucchesi
*Assistant Examiner*—Victor Hwang
(74) *Attorney, Agent, or Firm*—Porter, Wright, Morris & Arthur, LLP

(57) ABSTRACT

An improved therapeutic spa, hot tub, or hydrotherapy system includes one or more jet assemblies to form streams of water which translate in at least two degrees of freedom over a substantial portion of the user's body. The jet assemblies preferably move in patterns under automatic computer control as well as manual feedback by the user. The system preferably includes a body support, such as in the form of a chair. The support is at least partially water permeable so that the streams of water impinge the user through the body support. The jet assemblies preferably include unitary nozzles, pumps, and motors.

30 Claims, 11 Drawing Sheets

HYDROTHERAPY SYSTEM WITH TRANSLATING JETS

FIELD OF THE INVENTION

The present invention generally relates to a hydrotherapy system for a spa, hot tub or the like and, more particularly, to a hydrotherapy system which has one or more jets of water that translate over a user's body.

BACKGROUND OF THE INVENTION

Spas, hot tubs or the like typically have one or more water jets which are directed at each user located in the spa. There are many different types of water jets such as those which are static, rotate about the axis of their water flow, or stutter their water flow on and off. Some water jets can be manually positioned and/or their flow rate can be manually adjusted. Most water jets can be manually adjusted to control the amount of air injected into the water stream. This air generates turbulence in the water stream that is perceived as a more forceful jet. Some static jets can be turned on and off automatically.

Configurations of these water jets vary considerably. The simplest configuration has a single water jet directed at a particular area on the user's body such as the lumbar. A more elaborate configuration, often called a "therapy seat", uses many water jets (perhaps fifteen or more) directed at a variety of locations on the dorsal side of the user's body. In each of these configurations, the water stream impinges on a relatively small area of the user's body. If the user remains stationary for any period of time, the water jets quickly become uncomfortable as the target areas of the user's body are over stimulated.

In order to alleviate this over stimulation and to stimulate other areas of their bodies, users typically reposition themselves so that the water jets impact different areas of their bodies. This is often uncomfortable since most spa seats do not ergonomically support them in these other positions. In addition, this is inconvenient and frequent repositioning is not conducive to a relaxing experience.

Many attempts have been made to provide devices which stimulate a larger area of the user's body with varying degrees of success. For example, U.S. Pat. No. 5,893,180 to Moreland discloses a method and apparatus for providing a pulsed water massage, the disclosure of which is expressly incorporated herein in its entirety by reference. This device attempts to address many of the above-noted issues by having many water jets which are turned on and off in sequence with the analogy of the barrels of a gattling gun. While this method conceivably avoids over stimulating the target areas of the user's body, because each individual area can be stimulated for a short period and then allowed to rest, this technique requires many water jets and actuators. In addition, without using an unreasonable number of water jets, it stimulates only a small fraction of the user's body area, leaving the user with the necessity of repositioning himself to stimulate other areas. In this way, it has many of the same drawbacks as a convention therapy seat.

U.S. Pat. No. 5,738,638 to Henkin et al. discloses a pump powered massage apparatus having a water permeable membrane, the disclosure of which is expressly incorporated herein in its entirety by reference. The massage apparatus includes a hand-held water jet connected to a recirculation pump by a water hose. The water jet impacts the rear surface of a terry-cloth membrane which is held against the user's body to diffuse the impact of the water jet. The water jet can be fixedly mounted on the wall of the spa. While this device may provide massaging action to the user, it requires user intervention to move the device over the their body, some areas of the user's body, particularly the back, are difficult to stimulate without help from another individual or device, and the pump is integral to the spa (does not move with the hand held jet) so the joints and plumbing reduce system efficiency.

U.S. Pat. No. 5,418,985 to Antoine discloses a massage shower system, the disclosure of which is expressly incorporated herein in its entirety by reference. A user stands in a box while a ring of inward-facing jets automatically translates up and down about the user's body. While this device may provide massaging action to the user, it operates in a linear fashion from low to high (one degree of freedom) with a repetitiveness that would be perceived as irritating, it requires the user to stand which makes the experience less relaxing, and the pump is integral to the spa (does not move with the jet) so the joints and plumbing reduce system efficiency.

U.S. Pat. Nos. 5,093,942 and 5,027,450 to Lang each disclose an extendable and retractable spa jet, the disclosures of which are expressly incorporated herein in their entireties by reference. The device attempts to allow the user to massage most areas on their body without repositioning their entire body. It provides for a handheld jet connected to the basin by a hose which supplies the water. Additionally, a retraction mechanism stows the hose out-of-sight when not used and allows to jet to be used as a conventional side-of-basin fixed jet. While the device has the versatility of operating as either a fixed or hand held jet, fixed jets stimulate a single area and handheld jets require constant user intervention to hold the jet in position and some areas, particularly on the back, are difficult to stimulate without help from other individuals.

U.S. Pat. No. 4,853,987 to Jawarski discloses a unitary hydrotherapy jet and pump assembly, the disclosure of which is expressly incorporated herein in its entirety by reference. The device has one or more unitized hydrotherapy jet and pump assemblies mounted through the wall of a hot tub, spa, bathtub, whirlpool, or pool. By replacing the need for a primary pump servicing a plurality of hydrotherapy jets located at various points around the periphery of the tub, this invention reduces the heat and frictional losses in the pipes and fittings, reduces the need for leak testing before the unit leaves the factory, reduces the space required under or beside the tub to house the pump, motor and plumbing and eliminates the need for access doors to service them, and eliminates the discomfort and danger presented by one or more high velocity inlets. However, this invention requires the use of many expensive electric pump, motor, and jet assemblies and still stimulates only a small fraction of the user's body area. The problem of over stimulating the target areas remains.

U.S. Pat. No. 4,825,854 to Henkin et al. discloses a hydrotherapy massage method and apparatus, the disclosure of which is expressly incorporated herein in its entirety by reference. The apparatus has an automatically translating jet which repetitively follows a non-linear pattern and is driven along the path by water pressure. The jet is mounted in a recess of spa wall. This apparatus may cover a larger area of the user's body than many previous jet systems but has numerous limitations. Most of the disclosed embodiments result in the water jet moving away from the user as it translates. The remaining embodiment requires multiple rotating joints whose added friction would reduce the efficiency of the system. In each embodiment, the pump is integral to the spa (does not move with the jet) so the joints and plumbing reduce system efficiency, the water jet repetitively follows a driven path which would be perceived as irritating, and precludes the use of multiple jets.

U.S. Pat. No. 5,158,076 to Thomsen discloses a water jet massage apparatus, the disclosure of which is expressly incorporated herein in its entirety by reference. The apparatus includes a table upon which the user lies face down, a waterproof flexible membrane draped over the user, and a set of water jets which impinge on the waterproof membrane. The waterproof barrier keeps the user dry and the user may even remain clothed. The water jets move longitudinally along the body length allowing one side of the body to be massaged without the user moving. While this device may provide full coverage of one side of the user, it moves in only one dimension which is a significant limitation. The waterproof barrier isolates the user from the hot water which is the primary reason many people use hydrotherapy devices. In addition, the pump is integral to the base so the joints and plumbing reduce system efficiency.

U.S. Pat. No. 5,074,286 to Gillaspie et al. discloses a water jet massage apparatus, the disclosure of which is expressly incorporated herein in its entirety by reference. The apparatus s similar to the above Thomsen apparatus but the user lies face up on the table and the massage jets strike the waterproof membrane beneath the user. A stretching effect is created by causing each water jet to produce a 12 inch ridge of pressure which rotates 360 degrees about its center as the spray heads translate longitudinally don the body. The resultant discs of effected area overlap so the pressure ridges work against each other to create a "stretch". The membrane and the user are supported by maintaining sufficient water pressure under the membrane. This stretching technique is different in both method and perceivable effect from the kneading method of the present invention as described in detail hereinafter. The water jets move in only one dimension which is a significant limitation. The waterproof barrier isolates the user from the hot water which is the primary reason many people use hydrotherapy devices. In addition, the pump is integral to the base so the joints and plumbing reduce system efficiency.

Accordingly, there is a need in the art for an improved hydrotherapy system which services large areas of the user's body, avoids over stimulating any one particular area, is efficient, and/or is relatively inexpensive to produce, operate and maintain.

SUMMARY OF THE INVENTION

The present invention provides a hydrotherapy system which overcomes at least some of the above-noted problems of the related art. According to the present invention, a hydrotherapy system includes a jet assembly adapted to provide a stream of water and a translation assembly adapted to move the jet assembly in at least two degrees of freedom such that the stream of water is moved along a desired arbitrary path.

According to another aspect of the present invention, a hydrotherapy system includes a support assembly having a stationary body support for the user, a jet assembly adapted to provide a stream of water, and a translation assembly adapted to move the jet assembly such that the stream of water strikes the user through the body support.

According to yet another aspect of the present invention, a hydrotherapy system includes a jet assembly adapted to provide a stream of water and having a unitary nozzle and pump and a translation assembly adapted to move the jet such that the stream of water is moved along a desired path.

From the foregoing disclosure and the following more detailed description of various preferred embodiments it will be apparent to those skilled in the art that the present invention provides a significant advance in the technology and art of hydrotherapy systems. Particularly significant in this regard is the potential the invention affords for providing a easy-to-use, relaxing, high quality, feature-rich, low cost system. Additional features and advantages of various preferred embodiments will be better understood in view of the detailed description provided below.

BRIEF DESCRIPTION OF THE DRAWINGS

These and further features of the present invention will be apparent with reference to the following description and drawings, wherein.

Figure 2:
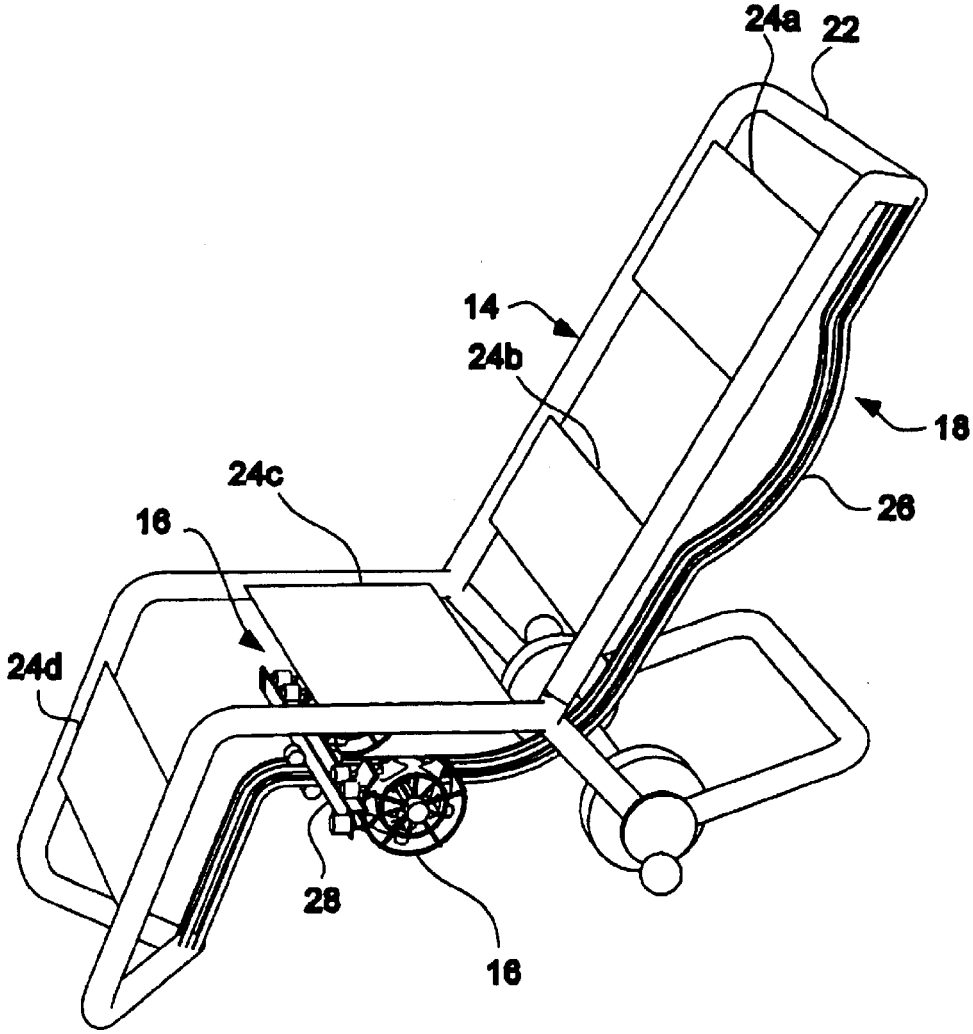
FIG. 2 is a perspective view of a chair assembly of the hydrotherapy system of FIG. 1.
Figure 3:
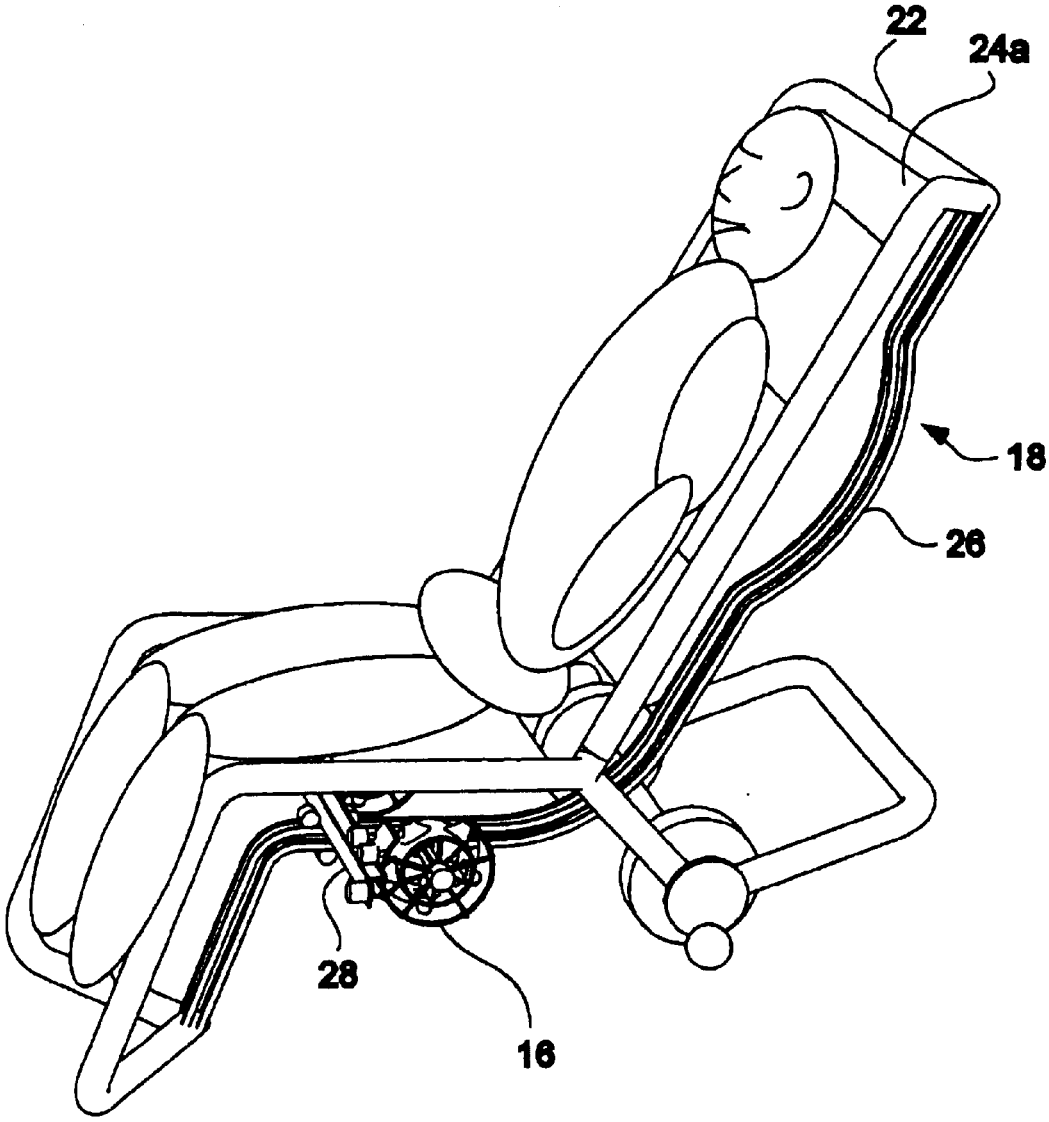
FIG. 3 is a perspective view of the chair assembly of FIG. 2 with a user seated thereon.
Figure 6:
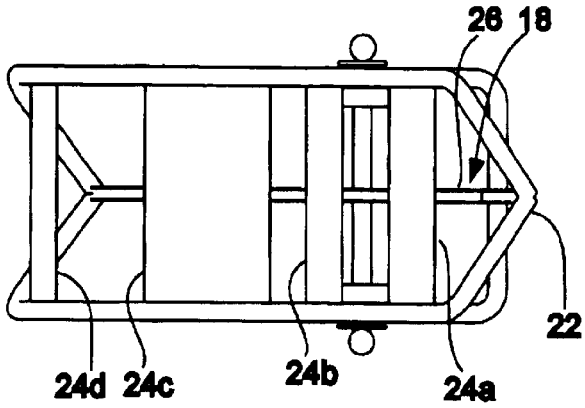
FIG. 6 is top plan view of the chair assembly of FIGS. 2 to 5.
Figure 4:
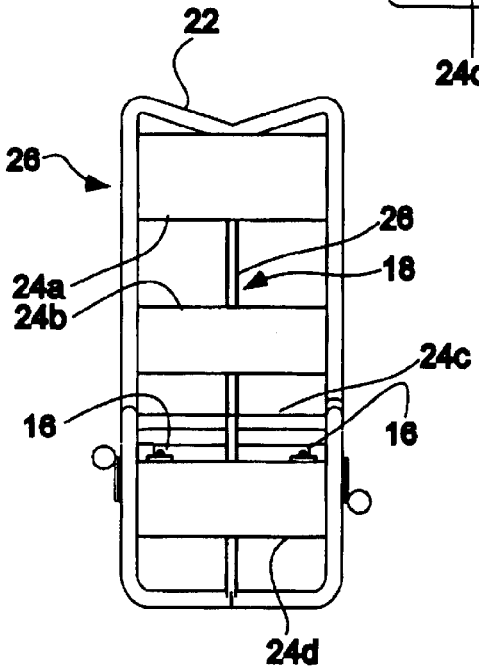
FIG. 4 is a front elevational view of the chair assembly of FIGS. 2 and 3.
Figure 5:
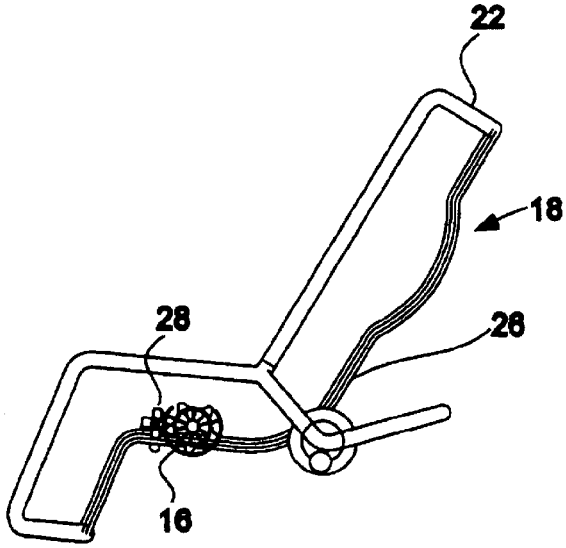
FIG. 5 is a side elevational view of the chair assembly of FIGS. 2 to 4.

It should be understood that the appended drawings are not necessarily to scale, presenting a somewhat simplified representation of various preferred features illustrative of the basic principles of the present invention. The specific design features of a hydrotherapy system as disclosed herein, including, for example, specific shapes of the support structure will be determined in part by the particular intended application and use environment. Certain features of the illustrated embodiments have been enlarged or distorted relative to others to facilitate visualization and clear understanding. In particular, thin features may be thickened, for example, for clarity or illustration. All references to direction and position, unless otherwise indicated, refer to the orientation of the hydrotherapy system illustrated in the drawings. In general, up or upward refers to an upward direction in the plane of the paper in FIGS. 1–3 and down or downward refers to a downward direction in the plane of the paper in FIGS. 1–3. In general, front or forward refers to left direction in the plane of the paper in FIGS. 1–3 and rear or rearward refers to a right direction in the plane of the paper in FIGS. 1–3.

DETAILED DESCRIPTION OF CERTAIN PREFERRED EMBODIMENTS

It will be apparent to those skilled in the art, that is, to those who have knowledge or experience in this area of technology, that many uses and design variations are possible for the improved hydrotherapy system disclosed herein. The following detailed discussion of various alternative and preferred embodiments will illustrate the general principles of the invention with reference to an improved spa or hot tub construction. Other embodiments suitable for other applications will be apparent to those skilled in the art given the benefit of this disclosure. The term "arbitrary path" is used herein and the claims to mean a path which is based on the discretion of user input, electronic control signals, and/or a combination of both, rather than a path specifically defined by the structure.

Figure 1:
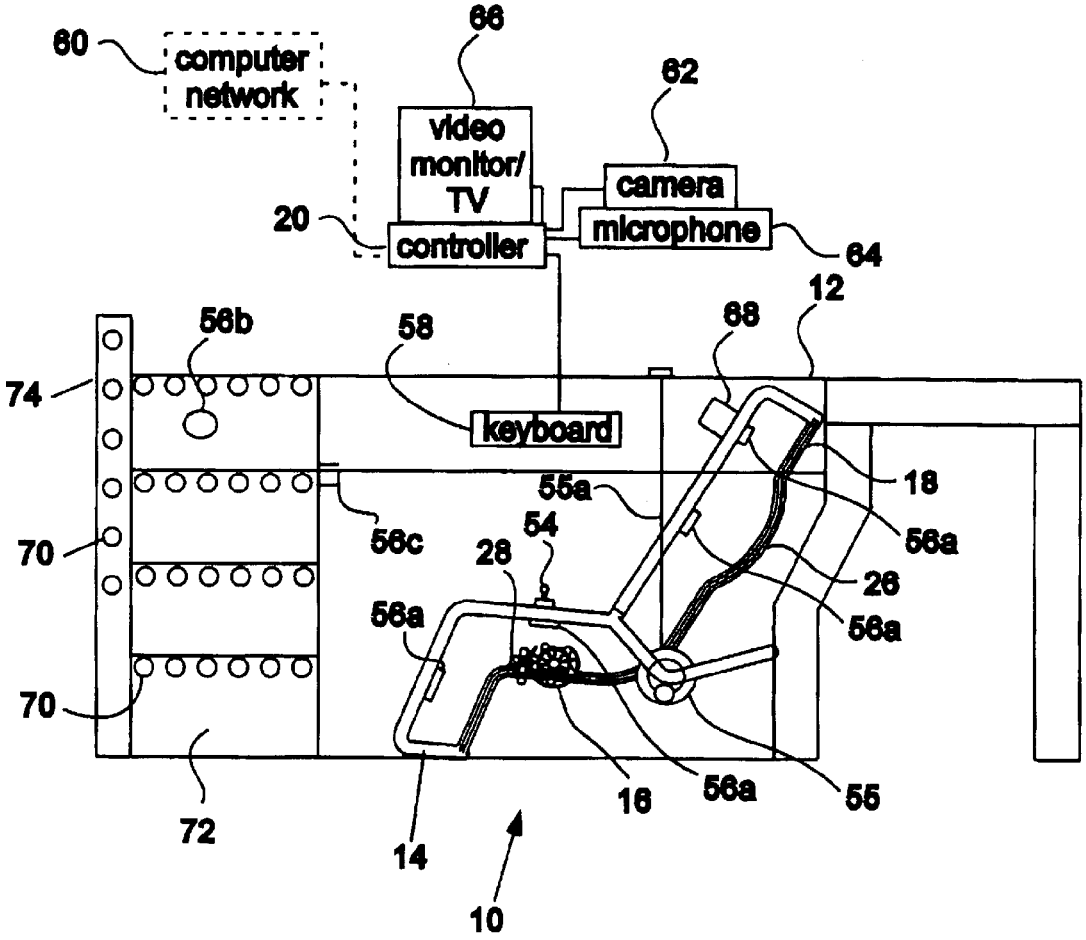
FIG. 1 is a schematic view of a hydrotherapy system according to a preferred embodiment of the present invention.

Referring now to the drawings, FIG. 1 illustrates a spa or hydrotherapy system 10 according to a preferred embodiment of the present invention. The hydrotherapy system 10 includes a tub 12 containing water, a support or chair assembly 14 for supporting a user's body and located within the tub 12, jet assemblies 16 for producing streams of water, a translation or rail stage or assembly 18 upon which the jet assemblies 16 translate or travel to impact significant portions of the user's body with the streams of water, and a control system 20 for translating each of the jet assemblies 16 along a desired path.

As best shown in FIGS. 2–6, the support or chair assembly 14 includes a frame 22 and a plurality of body supports 24*a*, 24*b*, 24*c*, 24*d* secured to the frame 22 which are adapted to support the user in a seated position. The illustrated embodiment includes four body supports: a head support 24*a*; a lumbar support 24*b*; a seat support 24c; and a lower leg support 24*d*. It is noted that there can be a greater or lesser number of body supports 24*a*, 24*b*, 24*c*, 24*d* and/or they can be sized to support a greater or lesser area of the user's body. The head and lumbar supports 24*a*, 24*b* are longitudinally adjustable along the frame 22 to adapt to users of different size. Securing straps (not shown) can optionally be provided near the lower leg support 24*d* to hold a user's legs against the lower leg support 24*d* if buoyancy and jet pressure cause the legs to float upwards away from the lower leg support 24*d*.

The body supports 24*a*, 24*b*, 24*c*, 24*d* are preferably formed by a web of flexible material such as, for example, a web or woven fabric or cloth. The flexible material can be impervious to the water jet to transmit only the impact of the water jet therethrough to the user on the other side or may be partially pervious to the water jet so that at least a portion of the water jet passes therethrough to directly impact the user on the other side. Of course, the flexible material can be a combination of the two. In order to massage the neck and head, the head support 24*a* is preferably made of a mostly or completely impermeable material that transmits the impact of the jet while preventing water spray from irritating the user or throwing water out of the tub 12. It would also be advantageous for users who wish to keep their hair dry.

While the support assembly 14 of the illustrated embodiment is in the form of a chair or seat, it is noted that the support assembly 14 can have other forms such as, for example, forms which support the use r in generally horizontal or vertical positions. To support the user in a generally horizontal position, the support assembly 14 can be in the form of a hammock stretched across the inside of the tub 12 with the jet assemblies 16 beneath the hammock. To support the user in a generally vertical position, the support assembly 14 can be in the form of vertical or slightly tilting wall inside the tub 12 which the user leans against with the jet assemblies 16 on the opposite side of the wall.

The support assembly or chair 14 preferably can tilt, translate or distort to raise the user partially or completely out of the water to let the user cool off and to aid entry and egress. This transformation or movement can be fully manual, manual with power assistance, or completely powered such as motorized. In the illustrated embodiment, dual manual winches 25 are secured to opposite sides of the frame assembly 22 so that the user can manually wind in or out a winch cable 25*a* attached to the top of the hot tub 12. Upper and lower chair support tubes 22*a*, 22*b* also function as glide bars, supporting the chair against the side wall of the tub 12 as the support assembly 14 is raised and lowered.

The illustrated rail assembly 18 includes a longitudinal or main rail 26 secured to the support assembly 14 and a lateral or secondary rail 28 movable along the longitudinal rail 26. The longitudinal rail 26 extends in a longitudinal direction and is spaced apart from the rear side of the support assembly 14 along a lateral central axis of the support assembly 14. The longitudinal rail 26 is offset by a suitable distance from the support assembly 14 to provide adequate clearance for the jet assemblies 16 and the lateral rail 28. The longitudinal rail 26 is shaped so that the jet assemblies 16 generally follow the contour of the support assembly 14 as they travel along the longitudinal rail 26 as described in more detail hereinafter. Ends of the longitudinal rail 26 are attached to the frame 22 of the support assembly 14. Mounted in this manner, the longitudinal rail 26 generally follows the contours of the body centerline of the user when the user is seated in the support assembly 14 (best shown in FIG. 3).

Figure 7:
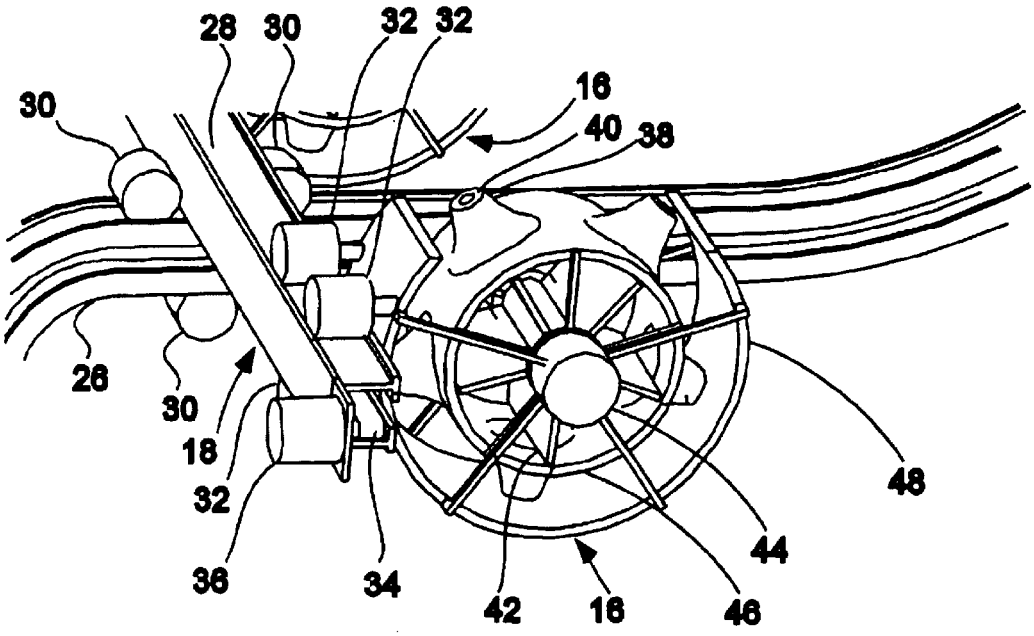
FIG. 7 is an enlarged and fragmented front perspective view of the jet assemblies of the chair assembly of FIGS. 2 to 6.
Figure 8:
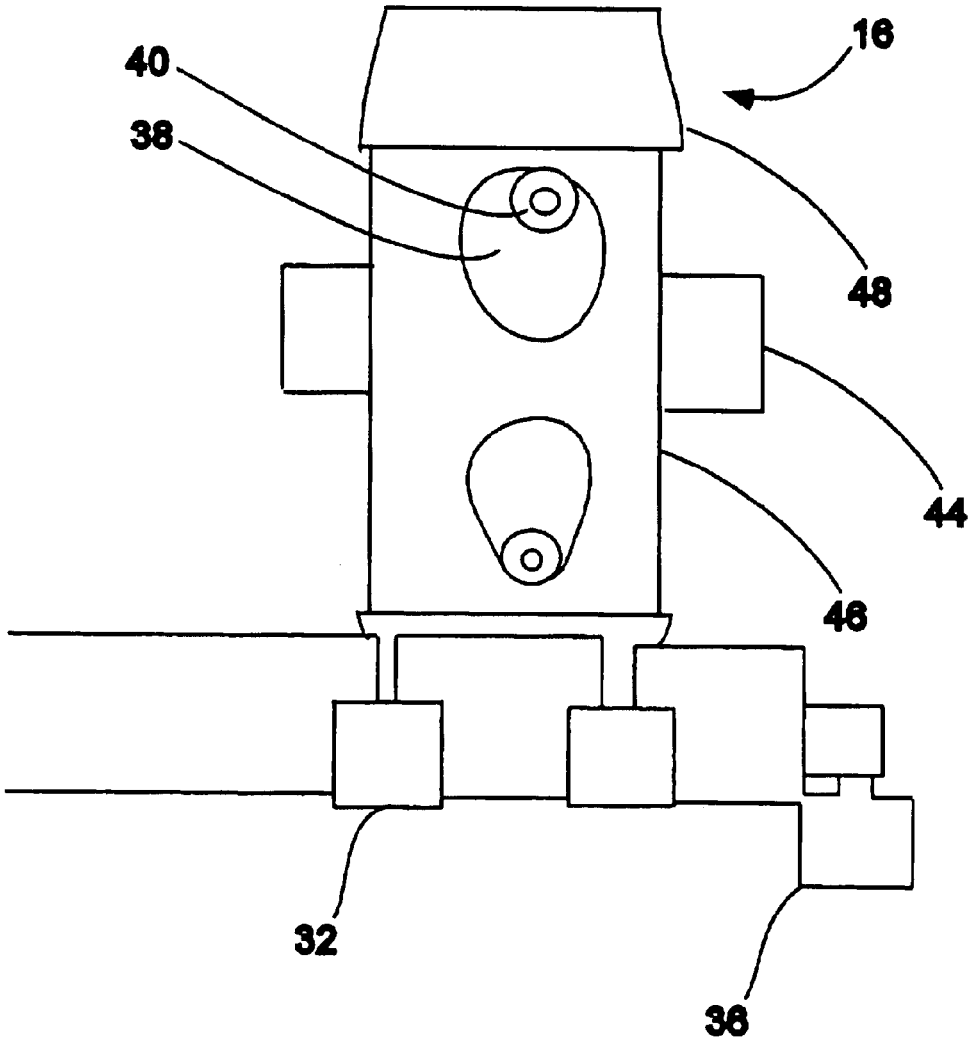
FIG. 8 is a top perspective view of the jet assemblies of FIG. 7.
Figure 9:
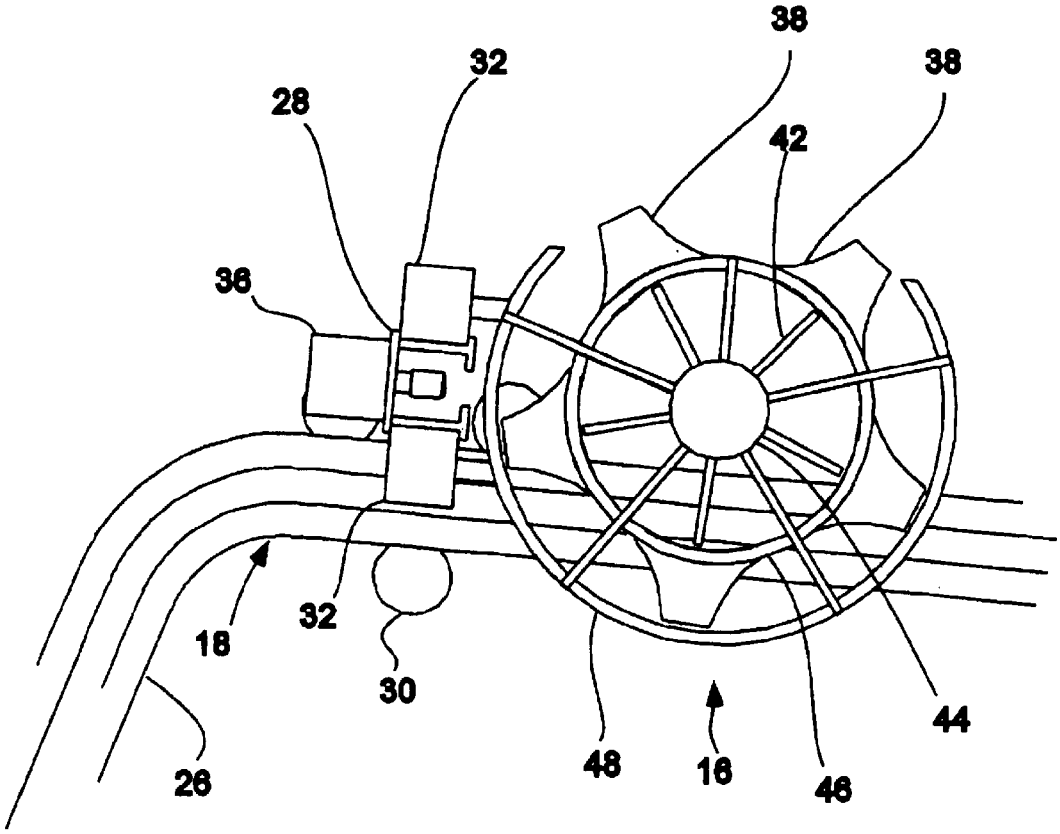
FIG. 9 is a side perspective view of a jet assembly of FIGS. 7 and 8.

As best shown in FIGS. 7–9, the lateral rail 28 extends in a lateral direction substantially perpendicular to the longitudinal rail 26 and is located adjacent a forward side of the longitudinal rail 26. The lateral rail 28 is sized to extend generally the width of the support assembly 14. The lateral rail 28 is supported by the longitudinal rail 26 such that the lateral rail 28 is movable along the length of the longitudinal rail 26. In the illustrated embodiment, three rotatable guide rollers 30 are secured to the lateral rail 28 which roll along the forward and rearward sides of the longitudinal rail 26 as the lateral rail 28 moves along the longitudinal rail 26 The lateral rail 28 is preferably driven along the longitudinal rail 28 by an endless belt or cable which extends within the cross-section of the longitudinal rail 26. The belt is rotated by an electric motor located near the lower end of the longitudinal rail 26. The lateral rail 28 is secured to the belt such that rotation of the belt by the motor moves the lateral rail 28 along the longitudinal rail 26. Preferably, the belt also carries electrical power and control signals to the lateral rail 28 and the jet assemblies 16. It is noted that the lateral rail can the moved along the longitudinal rail in other ways such as, for example, the lateral rail 28 can move along the longitudinal rail 26 using other means such as, for example, a motor mounted on the lateral rail 28. In this alternative embodiment, power and control signals are transmitted to the lateral rail 28 either via a linear bushing (mounted to the longitudinal rail 26) or a cable connected thereto.

The jet assemblies 16 are supported by the lateral rail 28 such that the jet assemblies 16 are movable along the length of the lateral rail 28. The illustrated embodiment utilizes two jet assemblies 16 along the lateral rail 28 such that each jet assembly 16 travels along approximately one-half of the lateral rail 28. It is noted, however, that a greater or lesser number of jet assemblies 16 can be utilized along the lateral rail 28 and/or additional lateral rails 28 can be provided with additional jet assemblies 16. In the illustrated embodiment, each jet assembly 16 has three rotatable guide rollers 32 secured thereto which roll along the upper and lower sides of the lateral rail 28 (as seen in FIG. 7) as the jet assembly 16 moves along the lateral rail 28. The jet assembly 16 is preferably driven along the lateral rail 28 by an endless belt or cable 34 which extends within the cross section of the lateral rail 28. The belt 34 is rotated by an electric motor 36 located near one end of the lateral rail 28. Each jet assembly 16 is secured to the belt 34 such that rotation of the belt 34 by the motor 36 moves the jet assembly 16 along the lateral rail 28. Preferably, the belt 34 also carries electrical power and control signals to the jet assembly 16. The two jet assemblies 16 are preferably secured to opposite sides of the belt 34 so that they symmetrically move toward or away from the longitudinal rail 26, and the centerline of the user (e.g. the spine). It is noted that the jet assembly 16 can be moved along the lateral rail 28 in other ways such as, for example, the jet assembly 16 can move along the lateral rail 28 using a motor mounted on the jet assembly 16. In this Alternative embodiment, power and control signals are transmitted to the jet assembly 16 either via a linear bushing (mounted to the lateral rail 28) or a cable connected thereto.

The illustrated rail system 18 enables the jet assemblies 16 to move in two axes (longitudinal and lateral) along the rear of the support assembly 14, that is, the rail system 18 acts as a two-axis motorized translation stage beneath the chair assembly 14. The longitudinal axis allows movement of the jet assembly 16 along the profile of the user's body, conforming to the bend of the hips and knees. The lateral axis allows movement of the jet assembly 16 from the centerline of the body (along the spine) out to the shoulders and arms. It should be appreciated that the rail system 18 can have many alternative forms to accomplish this goal within the scope of the present invention. For example, there could be additional longitudinal or lateral rails 28 and/or a longitudinal rail 26 could translate along lateral rails 28. It should also be appreciated that the rail system 18 can be adapted to enable the jet assemblies 16 to move in only one axes (such as either the longitudinal or lateral axis), three axes (such as longitudinal, lateral, and distal ventral dorsal axes), or other combinations of two axes (such as the longitudinal and distal axes or the lateral and distal ventral-dorsal axes).

In the illustrated embodiment, each jet assembly 16 is an integrated pump and jet. It is noted, however, that other, types of jet assemblies can be utilized within the scope of the present invention. The jet assembly 16 is immersed in water so that no plumbing is required to carry water to or from it. If air is to be injected into the water stream, it can be carried to the jet assembly 16 by an air hose that is far more compact and flexible than the corresponding water hose. It is believed that by reducing the plumbing and length the water must travel, a less powerful pump is required, turbulence is suppressed, and audible noise level is reduced compared to what is required with a conventional hydrotherapy jet solution. The added efficiency can obviate the need for air injection which is a means of increasing the perceived power of the water jet at the expense of increased sound levels and cooling the water jet. In addition, by increasing system efficiency, a large diameter jet can be implemented without requiring an excessively powerful pump. This larger diameter jet is less irritating to the user than conventional small diameter jets.

Each jet assembly 16 preferably has a nozzle 38 with an outlet orifice 40 adapted to produce a high pressure stream) of water, a propeller or impeller 42 which supplies water to the nozzle 38, and an electric motor 44, such as a 12 or 24 volt electric motor, submerged and directly adjacent to the impeller 42 to rotate the impeller 42. As the impeller 42 rotates, it pulls water from the surroundings in which it is submerged and directs water to the nozzle 38. Preferably, components of the jet assembly 16 are designed to reduce frictional drag (i.e. pressure drop) such as by making impeller supports from thin members instead of broad surfaces. Water is pushed into a tapering channel of the nozzle 38 which increases the pressure of the water. The water exits the outlet orifice 40 of the nozzle 38 as a high velocity stream and travels the distance from the nozzle 38 to the user or the chair support 14 supporting the user. During this travel, the water stream picks up additional water from the surroundings, increasing the diameter and mass of the water stream while reducing the water stream's velocity.

It is noted that the jet assembly 16 can alternatively be powered by means other than the submerged electric motor 44, such as, for example, a mains-powered electric motor/pump mounted outside the tub 12 can pump high-pressure fluid or gas (e.g. water or air) via flexible hoses to a turbine-driven motor and water pump mounted directly adjacent to the jet. As yet another alternative, a mains-powered electric motor mounted outside the tub 12 could drive a belt which runs inside the longitudinal rail 26 and drives one or more impellers. Instead of a belt, a hexagonal drive shaft can be used to reduce noise as this would generate less water turbulence away from the water jet. Universal joints can be used to transfer power from one drive shaft segment to another as it follows the contours of the longitudinal rail 26. It is understood that the scope of the present invention includes the pump being separable from the motor.

A kneading action is the most pleasurable kind of massage for most users. More specifically, most users find a stroke passing from point A to point B followed by a second stroke originating from close to point A and finishing close to point B, where the second stroke begins slightly before the first stroke ends, to be pleasurable. The illustrated embodiment generates this kneading action with the single electric motor 44 and the single rotor or impeller 42. Multiple water streams emerge from a rotating cylinder 46 on which is provided a plurality of the radially extending nozzles 38. Preferably, there are at least four nozzles 38 (the illustrated embodiment has five nozzles). The nozzles 38 are positioned such that two water streams are felt by the user at certain times but only one water stream is felt by the user when the nozzle 38 points directly at the user. A barrier 48 is provided inside or outside the cylinder 46 to block entry to or discharge from the nozzles 38 which will not impinge on the user. The impeller 42 is in the form of a multi-vane rotor which rotates about the central axis of the cylinder 46. The rotor 42 pulls water from the surroundings and propels it radially toward the nozzles 38. The illustrated embodiment uses a separate servo motor 50 to rotate the cylinder 46 to generate (among other possibilities) a kneading pattern at computer-controlled rhythms, changing direction (either kneading in the direction from toe to head or from head to toe), or stopping the rotation to generate static pressure.

As best shown in FIG. 1, the control system 30 preferably includes a programmable controller or computer 52 for operating and moving the jet assemblies 16 in a desired manner, a feedback or input device 54 for the user or other party to manually provide instructions to the controller 52, and sensors 56*a*, 56*b*, 56*c* for providing desired information to the controller 52 regarding conditions of the hydrotherapy system 10 or the user. The controller 52 is preferably adapted so that user can choose whether the jet assemblies 16 are moved manually by direction of the input device 54 or automatically by automated control of the controller 52. The illustrated input device 54 includes a remote pointer device, such as a joystick, trackball, or spaceball, located on the frame 22 of the support assembly 14 so that it can be easily operated by the user or by another party in the tub 12. The input device 54 can alternately be located away from the support assembly 14 for input by another party who may be located out of the tub 12 or some distance from the tub 12 or the hydrotherapy system 10. It is noted that the input device 54 an alternately include other devices such as a keyboard, 58 or connection to a computer network 60 such as an intranet or the Internet.

Automatic control by the computer controller 52 can control the jet assembly 16 positions according to one or more of the following methods:

1. following a pre-recorded pattern stored in memory of the controller 52. This pattern might be based on absolute dimensional offsets from an origin (e.g. ten inches above and three inches to the "right" of an origin) or the pattern might be based on relative or proportional offsets (e.g. 10% of body length above and 40% of hip width to the "right" of an origin).
2. moving randomly within certain constraints.
3. "interpreting" a music or video stream by converting tempo, pitch, volume, image features, or some combination of these into characteristic massage jet patterns.

Another key innovation is the method of specifying the massage pattern. How does one easily specify the location, speed, and intensity of the water jets. The specification and evolution of these massage patterns is a technology which can be described as "evolving preferences". One method of specifying these preferences would be to describe the entire massage in detail as a motion profile. This method is used to describe the motion of a milling machine in Computer Aided Manufacture (CAM). Computers like quantifiable attributes such as these. However, humans are not so good at describing a complex pattern so rigidly—we are more qualitative.

There is much scope for developing innovative "evolving" massage patterns algorithms based on automated "experiments" and incremental subjective user feedback. Put simply, the controller 52 can try out various patterns, receive user feedback—"I liked that or didn't like it"—and using the response to bias long-term preferences. Preferably, the controller 52 is pre-programmed with a number of basic patterns such as linear stroking, circles, and pulsing as well as identifying a number of key locations such as around the shoulder blades and the erector spinae muscle group so the user would receive a decent massage upon delivery.

Upon entering the hydrotherapy system 10, the user might identify him/herself and select either a relaxation or invigoration mode. The controller 52 would then follow a massage pattern whose basic patterns rely on a set of user-specific variables. In its simplest mode of operation, a single value would represent each of these parameters and the massage pattern would follow them strictly—"central value" adaptation method. These variables describe the user's preferences: jet pressure, jet diameter, knead speed, knead direction (up or down), duration of focus on each body area, and a host of other such parameters. Initially, these variables would be set to defaults but after many uses, the controller 52 would adapt to the user by reacting to feedback. For example, during the massage the controller 52 could verbally ask if the jet intensity should be increased, decreased, or left the same and prompt the user to respond by squeezing the left, right, or both feedback devices 54, respectively. If the user specifies that the jet intensity should be increased, the central value for this parameter would be biased upwards by either a set amount or by an amount inversely proportional to the number of interactions with this user (the controller 52 might learn more quickly when new).

Alternatively, the parameters could be described with probability distributions defined by a central value and a measure of allowable deviation. Jet pressure, for example, would randomly vary around the central value within tolerances defined by the deviation limits. This "probability distribution" adaptation method is robust insofar is it only infrequently produces an unacceptable outcome but it requires significant understanding of which variables influence the massage quality. The advantage of probability distribution over central value method is that the extra variability makes the device seem less mechanical and hence more enjoyable.

To produce even more massage pattern variation, one might employ a "genetic algorithm" (GA) approach using evolutionary techniques—reproduction, crossover, and mutation. GA is well-understood in the field of machine learning and requires little understanding of what factors make some massages better than others. However, because it is evolutionary, it is prone to producing "monsters" (unacceptable massage patterns) when trained with small data sets. Unfortunately, large data sets require either long training periods and/or pooling results from many similar hydrotherapy devices, perhaps via Internet connectivity.

The subtleties of the feedback mechanism are established as the controller 52 is trained. Each user develops a personal vocabulary with which to communicate with the hydrotherapy system 10 that would be different from other users' vocabularies. One might use neural nets for this sort of learning behaviour or some other trainable system. Each user is recognized upon entry into the tub 12 by some combination of body shape (or shape of a portion of the body), hand shape, fingerprint, voice recognition, way in which he or she manipulates the feedback mechanisms or a manual selection mechanism such as pressing button(s). Upon recognition, the controller 52 loads the pattern established for that user and proceeds.

The control system 20 is upgradable either with additional actuators (jets, motors, vibrators, heaters), sensors (feedback mechanisms, position encoders, microphones, cameras, temperature or pressure sensors), or computing power (processor speed, memory, software upgrades) while retaining the education it has acquired. Given rev 1 of the hardware and proper training, it might be capable of attaining a certain level of massage ability. At that point, it is no longer capable of advancing because it's computational unit lacks the complexity required. It is possible at that point to increase the controller's complexity while retaining the training it's developed.

The controller 52 is preferably removable from the hydrotherapy system and connected to a personal computer for occasional connectivity or could be permanently connected either to a local network (such as an intranet) or a global public network (such as the Internet). These connections may be wired or wireless. The preferred method for connectivity is to incorporate a cellular packet transceiver into the device which enables 2-way data exchange without requiring a telephone socket or connection. Any of these connectivity options allow the controller 52 to obtain software upgrades and exchange massage programs with other users. Another desirable feature is for a user's preferences to be "portable", that is, to be able to use the same evolved training and vocabulary for multiple hydrotherapy systems, perhaps at geographically distant sites. This is accomplished either by transferring this information via a computer network 60 or by storing them on removable media such as, for example, flash memory.

Preferably, the control system 20 includes remote feedback mechanisms. If a remote operator is controlling the hydrotherapy system 10, he or she would probably require feedback from the user being manipulated. This feedback might take the form of audio, video, and/or tactile signals. For example, a camera 62 and microphone 64 might be pointed on the user and this audio-visual signal transmitted to the operator. In addition, signals from the user input device 54 (joysticks, spaceballs, etc) is fed back to the operator and converted to audio, visual, and/or tactile feedback. Biofeedback can be transmitted to inform the operator of the user's excitement, pleasure, or pain sensations.

In addition to or instead of the water jet assemblies 16, other actuators can be used depending on the effect desired. One could include air, mist, and physical manipulators such as feathers or more rigid objects. Any of these manipulators could be temperature controlled, emit IR, electrical or magnetic fields, or vibrate. For example, a rubberized manipulator could be warmed or cooled using an internal Peltier device.

Additionally, audo and/or video stimulation can be utilized. Audio such as music would add to the spa experience. By providing a video monitor 66, the hydrotherapy system can either fully or partially replace the TV-watching couch and/or personal computer task station, allowing the user to spend more time being massaged while immersed in water. For these reasons, the hydrotherapy system 10 can advantageously have either a built-in audiovisual system or be equipped with facilities to install them. Audio is preferably provided by either a headset (either wireless or corded) or by speakers 68 mounted to the frame 22 at either side of the user's head. If a computer interface is desired, a waterproof keyboard 58 and pointing device 54 must be provided.

Preferably, lights 70 are provided which guide the user. When user approaches the hydrotherapy system 10, the lights make steps 72 and handrails 74 glow. Once the user is seated, the lights 70 make controls glow so they can be easily grasped. Once the user is fully situated, the lights 70 can pulse along with the music and/or massage intensity.

The sensors, 56*a*, 56*b*, 56*c* of the control system 20 preferably include sensors for detecting the presence of the user in the support assembly 14, the size and/or shape of the user, the approachment of the user to the hydrotherapy system 10, and the level of the water in the tub 12. Preferably an array of pressure pads 56*a* are woven into or secured to the body supports 24 of the chair support 14. These pressure pads are connected to the controller 52 to provide signals indicating both the presence of the user and the approximate size and shape of the user. These signals allow the controller 52 to automatically shut off the jet assemblies 16 when the user exits the chair support 14 and to adapt the motion of the jet assemblies 16 to different body shapes, sizes and positions when utilizing a preprogrammed pattern. A motion sensor 56*b* can be positioned near the entrance of the hydrotherapy system 10 to send signals to the controller 52 that a user is approaching. A water level sensor 56*c* can be utilized within the tub 12 to ensure that the water in the tub is at a necessary level so that the jet assemblies 16 are not moved out of the water.

Figure 10:
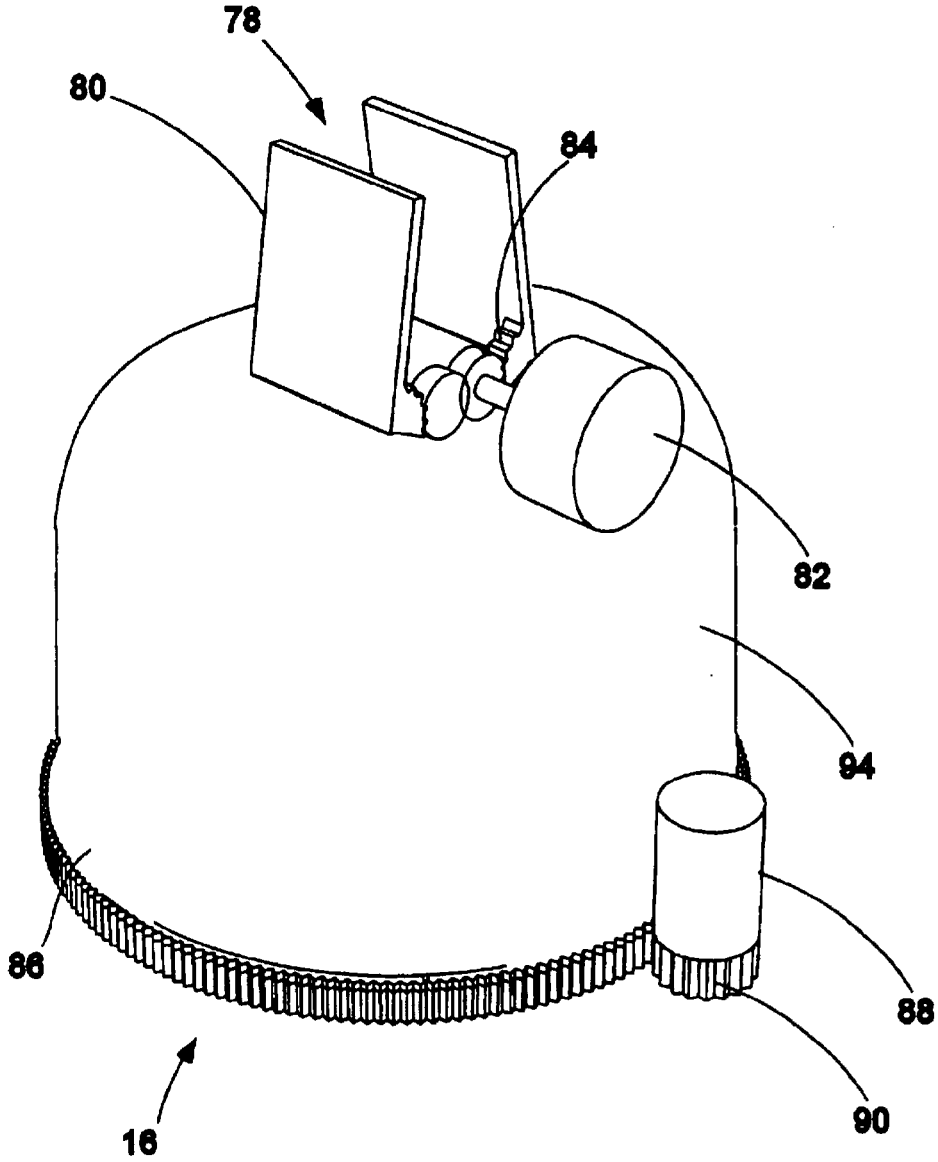
FIG. 10 is a perspective view of a jet with adjustable outlet and inlet.
Figure 11:
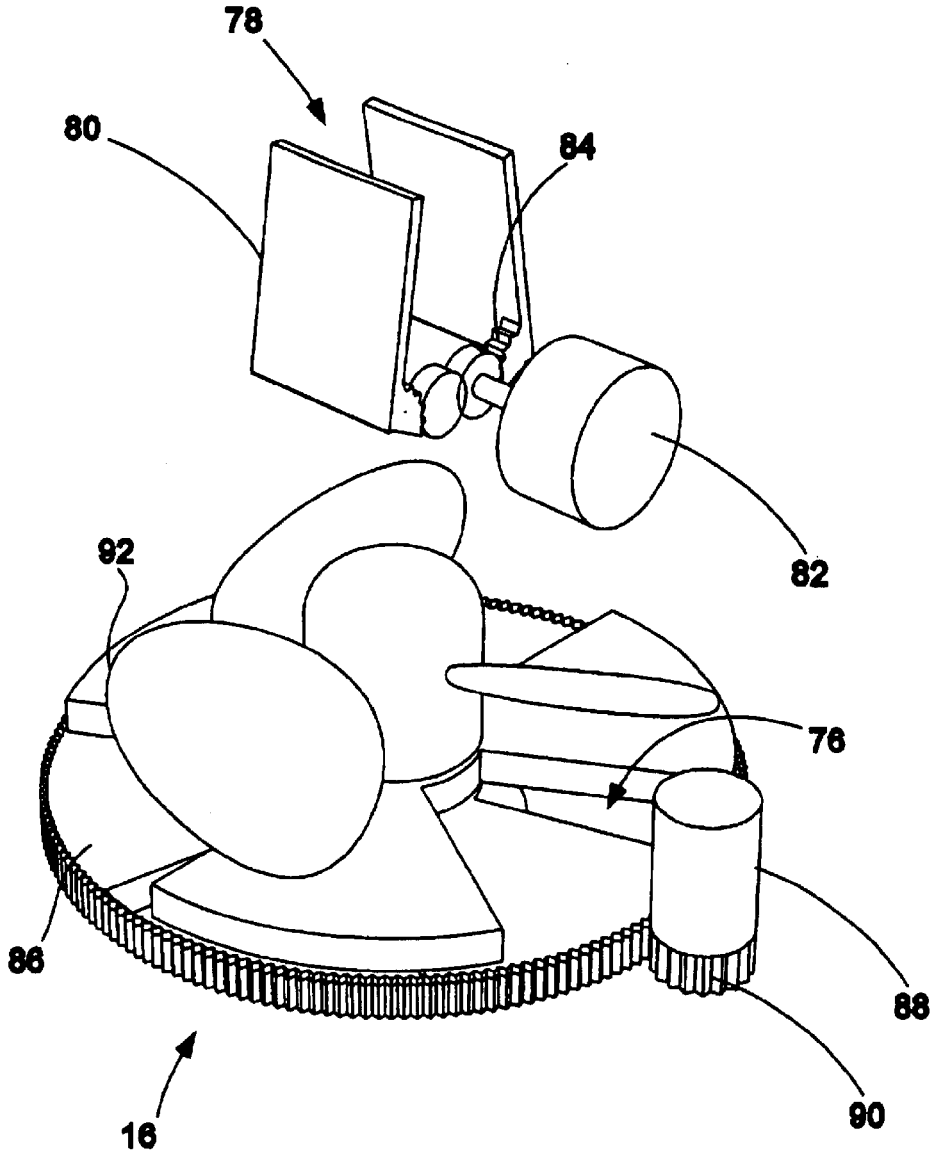
FIG. 11 is a perspective view of the jet of FIG. 10 with the outer housing removed.

FIGS. 10 and 11, illustrate an alternative jet assembly 16 having an adjustable inlet aperture 76 and an adjustable outlet aperture 78. The outlet aperture 78 is provided with a pair of opposed, pivotable flaps 80 which pivot toward and away from each other to vary the size of the outlet aperture 78. The illustrated flaps 80 are pivoted by an electric motor 82 connected to the flaps 80 through suitable gearing 84. A suitable impeller 92 is provided between the inlet aperture 76 and the outlet aperture 78 within the case or housing 94. An electric motor is provided outside the housing to rotate the impeller 92. Preferably, the speed of the motor is variable to adjust the water jet stream exiting the nozzle assembly 16. The inlet aperture 76 is provided with a rotatable cover plate 86 which can be rotated to vary the size of the inlet aperture 76 from 0% to about 50% of the total area. At 0%, no water passes through the inlet aperture 76 so that water can be shut off without closing the outlet aperture 78 which could produce a painfully intense water jet stream before complete water shut off. An electric motor 88 is provided to rotate the cover plate 86 through suitable gearing 90. The electric motor driving the impeller 92 is likely to possess too much inertia to stutter on and off several times per second. The control of the inlet aperture 76 allows rapid pulsing (stuttering) of the jet which would not otherwise be possible without producing a painfully intense jet as described above.

Figure 12:
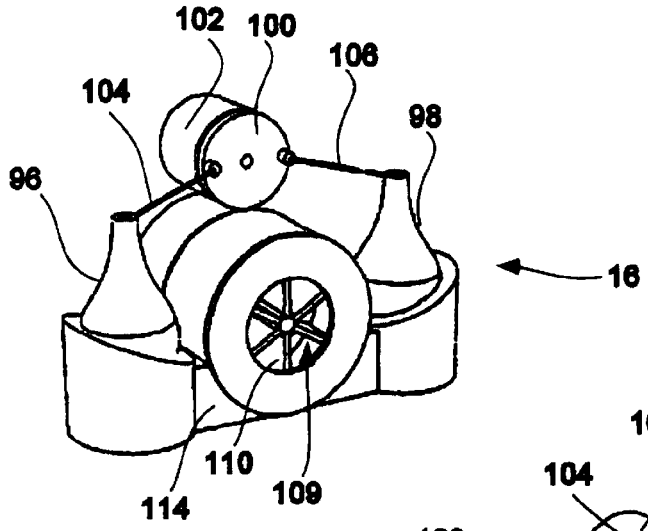
FIG. 12 is perspective view of an alternative embodiment of a "kneading" jet assembly according to the present invention wherein two jets are generally parallel.
Figure 13:
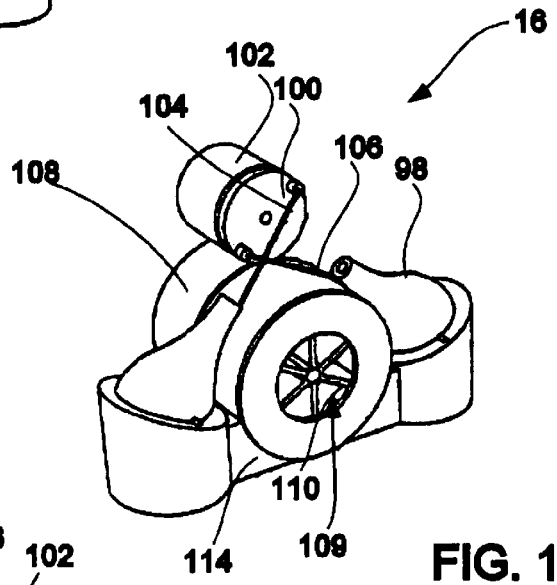
FIG. 13 is a perspective view of the jet assembly of FIG. 12 wherein the two jets are generally intersecting.
Figure 14:
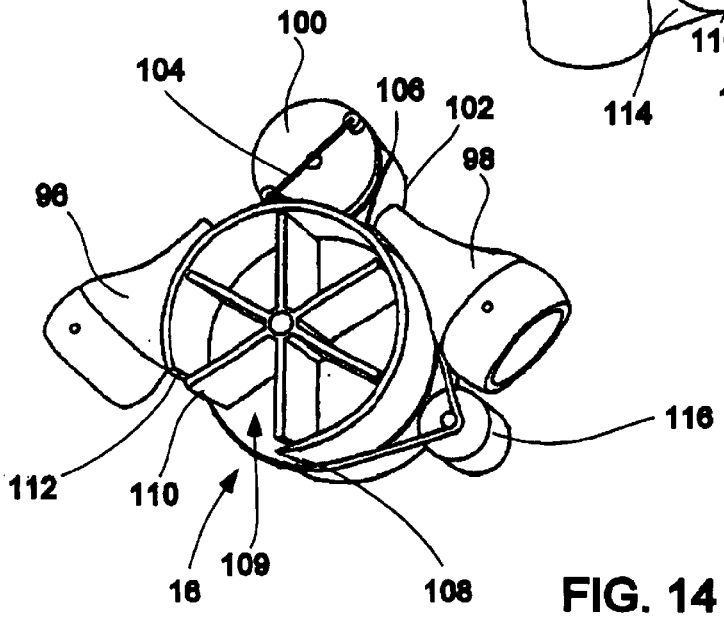
FIG. 14 is a perspective view of the jet assembly of FIGS. 12 and 13 with components removed for clarity.

FIGS. 12, 13, and 14 illustrate an alternative "kneading" jet assembly 16 having first and second pivotable jets 96, 98, a motor driven wheel 100, a motor 102 for selectively rotating the wheel 100, push/pull rods 104, 106 connecting the jets 96, 98 to the wheel 100 to cause the jets 96, 98 to move between parallel and intersecting upon rotation of the wheel 100. A barrel 108 surrounds a vane or impeller 110 of the centrifugal pump and has an opening or aperture 112 which is sized to cooperate with a base housing 114 such that water is provided to the first jet 96, the second jet 98, or both of the jets 96, 98 depending on the orientation of the barrel 108. A second motor 116 is provided to selectively drive the barrel 108 to a desired orientation. A third motor (not shown) selectively rotates the vane 110 of the centrifugal pump 109. The jets have spherically-shaped bases such that they provide a seal with the housing 114 in each orientation and therebetween.

To create a kneading effect, the barrel 108 is positioned such that water is diverted exclusively to the first jet 96 and the wheel 100 is rotated such that the jets 96, 98 are positioned generally parallel as shown in FIG. 12. The wheel 100 is rotated to move the jets 96, 98 so that they converge and simultaneously the barrel 108 is rotated such that water is diverted to both jets 96, 98. Finally, the barrel 108 is positioned such that water is again exclusively directed to the first jet 96 and simultaneously the wheel 100 is rotated such that the jets 96, 98 are generally parallel. If static pressure is desired, water can be diverted to one or both of the jets 96, 98 while the barrel 108 and the wheel 100 are maintained in a constant position.

Figure 15:
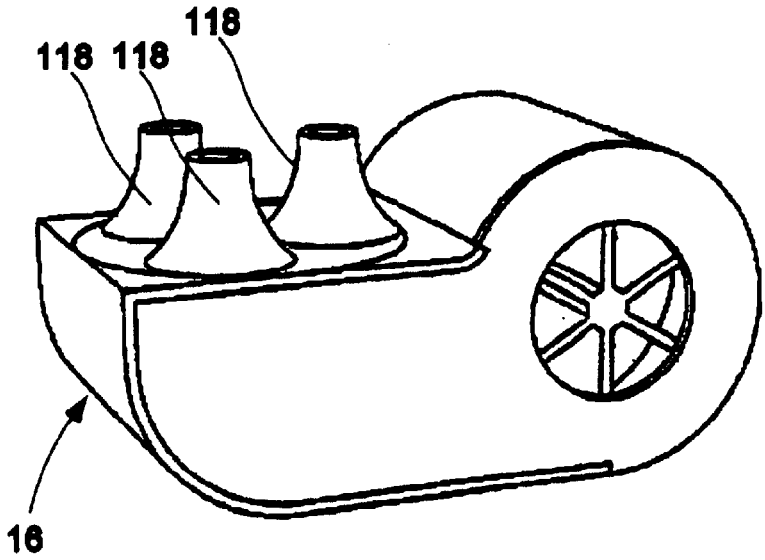
FIG. 15 is perspective view of another alternative embodiment of a "kneading" jet assembly according to the present invention.
Figure 16:
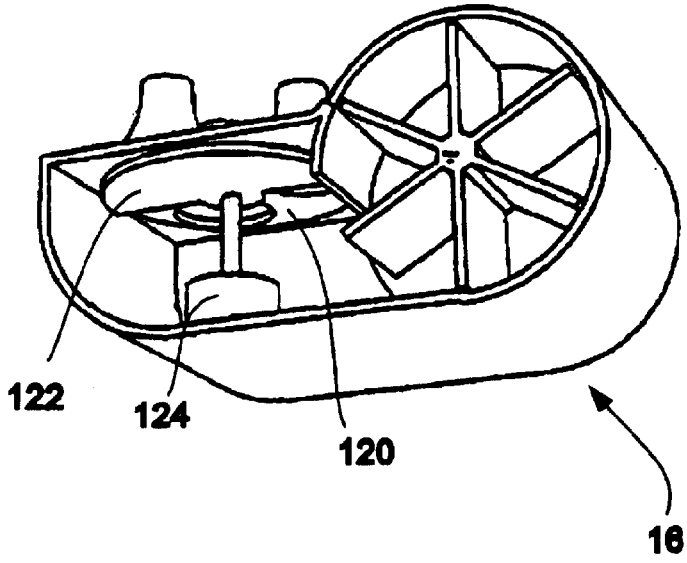
FIG. 16 is a perspective view of the jet assembly of FIG. 15 with components removed for clarity.

FIGS. 15 and 16 illustrate another alternative "kneading" jet assembly 16 having turret of jets or nozzles 118 mounted on a rotatable nozzle plate 120, a rotatable baffle plate 122, and at least one motor 124 for independently rotating the nozzle plate 120 and the baffle plate 124. While the illustrated embodiment has three generally parallel jets 118, it is noted that a greater or lesser number of jets 118 can be utilized within the scope of the present invention. The illustrated baffle plate 122 is located directly below the nozzle plate 120 and is sized and shaped such that only one or two of the jets 118 receive water from the centrifugal pump at any given time depending on the orientation of the baffle plate 122 relative to the nozzle plate 120. The illustrated baffle plate 122 covers or blocks about one-half of the nozzle plate 120. The illustrated nozzle and baffle plates 120, 122 are coaxial and the motor 124 is a two axes motor which rotates both of the plates 120, 122 independently. It is noted that alternative configurations of the baffle plate 122 and/or nozzle plate 120 permits use of two separate single axis motors.

With the position of the baffle plate 122 held constant, rotating the nozzle plate 120 produces a "kneading effect" along an arcuate path. This arcuate path's orientation can be altered by rotating the baffle plate 122.

From the foregoing disclosure and detailed description of certain preferred embodiments, it will be apparent that various modifications, additions and other alternative embodiments are possible without departing from the true scope and spirit of the present invention. For example, it will be apparent to those skilled in the art, given the benefit of the present disclosure, that the support system and/or the rail system can have many different forms. The embodiments discussed were chosen and described to provide the best illustration of the principles of the present invention and its practical application to thereby enable one of ordinary skill in the art to utilize the invention in various embodiments and with various modifications as are suited to the particular use contemplated. All such modifications and variations are within the scope of the present invention as determined by the appended claims when interpreted in accordance with the benefit to which they are fairly, legally, and equitably entitled.

What is claimed is:

1. A hydrotherapy system for massaging a body of a user, said hydrotherapy system comprising:

a jet assembly having first and second nozzles adapted to provide separate first and second streams of water;

a translation assembly having a first degree of freedom to move the jet assembly along a first path and a second degree of freedom to move the jet assembly along a second path;

wherein the second path is non-coincident to the first path;

a controller operably connected to the translation assembly to automatically move the jet assembly along a desired path within a surface formed by the first and second paths;

wherein the jet assembly forms a kneading action massage by successively moving the first and second nozzles along an unclosed path to successively engage the user's body with the first and second streams of water such that the second stream of water engages the user before the first steam of water disengages the user; and wherein the unclosed path includes a starting location where the first and second streams of water start engaging the user and an exiting location which is spaced apart from the starting location where the first and second streams of water stop engaging the user.

2. The hydrotherapy system according to claim 1, wherein the jet assembly includes a rotatable cylinder which rotates about a central longitudinal axis and is provided with the first and second nozzles to form the first and second streams of water and wherein the first and second nozzles radially extend from the central longitudinal axis so that the first and second streams of water flow perpendicular to the central longitudinal axis.

3. The hydrotherapy system according to claim 2, wherein the controller comprises a programmable controller such that rotation of the cylinder is under computer control to select between rotation of the cylinder in either direction about the central longitudinal axis to obtain two directions of unidirectional kneading action massage.

4. The hydrotherapy system according to claim 2, further comprising a motor for rotating the cylinder with variable speed.

5. The hydrotherapy system according to claim 1, wherein the first and second nozzles are independently pivotable nozzles to form the first and second streams of water and the jet assembly includes a water distribution system to selectively direct water to desired ones of said pivotable first and second nozzles.

6. The hydrotherapy system according to claim 5, wherein the water distribution system includes a rotating barrel to selectively direct water to desired ones of said pivotable nozzles.

7. The hydrotherapy system according to claim 5, wherein the controller comprises a programmable controller such that movement of the pivotable nozzles and actuation of the water distribution system is under computer control to select between two directions of kneading action.

8. The hydrotherapy system according to claim 5, further comprising a first and second motors for moving the pivotable nozzles and for actuating the water distribution system respectively.

9. The hydrotherapy system according to claim 1, wherein the jet assembly moves the first and second nozzles from the exiting location back to the starting location without engaging the user with the first and second streams of water respectively so that the unidirectional kneading action massage is repeated.

10. The hydrotherapy system according to claim 1, further comprising a support adapted to support a user, and wherein the support includes a flexible membrane and the first and second streams of water impinge the user through the flexible membrane.

11. A hydrotherapy system comprising:

a jet assembly having a nozzle adapted to provide a stream of water;

a translation assembly having a first degree of freedom to move the jet assembly along a first path and a second degree of freedom to move the jet assembly along a second path;

wherein the second path is non-coincident to the first path;

a controller operably connected to the translation assembly to automatically move the jet assembly along a desired path within a surface formed by the first and second paths;

wherein the controller includes a programmable controller and wherein the jet assembly includes an inlet aperture of variable size, the inlet aperture having a movable cover to vary the size of the inlet aperture, and the jet assembly is operably connected to the controller such that movement of the cover is controlled by the controller and the cover can be closed to shut off supply of water to the jet assembly;

wherein the jet assembly includes an impeller located upstream of the nozzle such that the impeller provides pressurized water to the nozzle and downstream of the inlet aperture such that the movable cover controls supply of water to the impeller; and wherein the controller positions the cover to a plurality of positions between a full open position and a full closed position to vary the size of the inlet aperture.

12. A hydrotherapy system comprising:

a jet assembly adapted to provide a stream of water;

a translation assembly having a first degree of freedom to move the jet assembly along a first path and a second degree of freedom to move the jet assembly along a second path;

wherein the second path is non-coincident to the first path;

a controller operably connected to the translation assembly to automatically move the jet assembly along a desired path within a surface formed by the first and second paths;

a support assembly for the user in the form of a chair and wherein the translation assembly is adapted to generally conform to the chair;

wherein the support assembly includes a seat support and a lumbar support; and wherein the translation assembly moves the jet assembly along a curved path when moving the jet assembly from positions under the seat support to positions behind the lumbar support.

13. A hydrotherapy system for massaging a body of a user, the hydrotherapy system comprising:

a support adapted to support the user;

a first nozzle adapted to provide a first stream of water impinging the user;

a second nozzle adapted to provide a second stream of water impinging the user;

a control system which successively moves the first and second nozzles along an unclosed path to successively impinge the user with the first and second streams of water to form a kneading action massage;

wherein the unclosed path includes a starting location where the first and second streams of water start impinging the user and an exiting location which is spaced apart from the starting location where the first and second streams of water stop impinging the user; and wherein the second nozzle starts along the path before the first nozzle exits the unclosed path.

14. The hydrotherapy system according to claim 13, wherein the control system includes a rotatable cylinder which rotates about a central longitudinal axis and the first and second nozzles radially extend from the central longitudinal axis so that the first and second streams of water flow perpendicular to the central longitudinal axis.

15. The hydrotherapy system according to claim 14, wherein the control system includes a programmable controller such that rotation of the cylinder is under computer control to select between rotation of the cylinder in either direction about the central longitudinal axis to obtain two directions of the unidirectional kneading action massage.

16. The hydrotherapy system according to claim 15, wherein the control system includes a variable speed motor for rotating the cylinder with variable speed.

17. The hydrotherapy system according to claim 13, wherein the first and second nozzles are independently pivotable about first and second pivot axes respectively and further comprising a water distribution system to selectively direct water to desired ones of the first and second nozzles.

18. The hydrotherapy system according to claim 17, wherein the water distribution system includes a rotating barrel to selectively direct water to desired ones of the first and second nozzles.

19. The hydrotherapy system according to claim 17, wherein the control system includes a programmable controller such that pivoting movement of the first and second nozzles and actuation of the water distribution system is under computer control to select between two directions of the kneading action.

20. The hydrotherapy system according to claim 17, further comprising a first and second motors for pivotably moving the first and second nozzles and for actuating the water distribution system, respectively.

21. The hydrotherapy system according to claim 13, wherein the jet assembly moves the first and second nozzles from the exiting location back to the starting location without engaging the user with the first and second streams of water respectively so that the unidirectional kneading action massage is repeated.

22. The hydrotherapy system according to claim 13, wherein the support includes a flexible membrane and the first and second streams of water impinge the user through the flexible membrane.

23. A hydrotherapy system comprising:

a support assembly adapted to support a user in a seated position and having a seat support and a lumbar support;

a jet assembly adapted to provide a stream of water;

a translation assembly adapted to move the jet assembly along a path conforming to the support assembly and extending adjacent the seat support and the lumbar support; and wherein the translation assembly moves the jet assembly along a curved portion of the path when moving the jet assembly from positions under the seat support to positions behind the lumbar support.

24. The hydrotherapy system according to claim 23, wherein the translation assembly has a first linear degree of freedom to move the jet assembly along a first linear path and a second linear degree of freedom to move the jet assembly along a second linear path and wherein the second linear path is perpendicular to the first linear path.

25. The hydrotherapy system according to claim 24, further comprising a controller operably connected to the translation assembly to automatically move the jet assembly along a desired path within a plane formed by the first and second linear paths.

26. The hydrotherapy system according to claim 23, wherein the seat assembly further includes a head support and the path extend adjacent the head support.

27. The hydrotherapy system according to claim 23, wherein the seat assembly further includes a leg support and the path extend adjacent the leg support.

28. The hydrotherapy system according to claim 27, wherein the translation assembly moves the jet assembly along another curved portion of the path when moving the jet assembly from positions under the seat support to positions behind the leg support.

29. The hydrotherapy system according to claim 27, wherein a linear portion of the path adjacent the seat support is horizontal.

30. A hydrotherapy system comprising:

a jet assembly having a nozzle adapted to provide a stream of water;

a translation assembly operably connected to the jet assembly to move the jet assembly;

a controller operably connected to the translation assembly to move the jet assembly along a desired path;

wherein the controller comprises a programmable controller;

wherein the jet assembly includes an inlet aperture of variable size, the inlet aperture having a movable cover to vary the size of the inlet aperture, and the jet assembly is operably connected to the controller such that movement of the cover is controlled by the controller and the cover can be closed to shut off supply of water to the jet assembly;

wherein the jet assembly includes an impeller located upstream of the nozzle such that the impeller provides pressurized water to the nozzle and downstream of the inlet aperture such that the movable cover controls supply of water to the impeller; and wherein the controller positions the cover at a plurality of position between a full open position and a full closed position to vary the size of the inlet aperture.

* * * * *